United States Patent [19]

Sekiguchi

[11] Patent Number: 4,474,485

[45] Date of Patent: Oct. 2, 1984

[54] DOT MATRIX PRINTING HEAD

[75] Inventor: Bunzo Sekiguchi, Hatoyama, Japan

[73] Assignee: Chuwa Giken Co., Ltd., Tokyo, Japan

[21] Appl. No.: 519,117

[22] Filed: Aug. 1, 1983

Related U.S. Application Data

[63] Continuation of Ser. No. 330,340, Dec. 14, 1981, abandoned.

[51] Int. Cl.[3] ..... B41J 3/12

[52] U.S. Cl. ..... 400/121; 101/93.04; 400/124

[58] Field of Search ..... 400/121, 124; 101/93.04

[56] References Cited

U.S. PATENT DOCUMENTS

| | | | |
|---|---|---|---|
| 3,904,011 | 9/1975 | Matschke | 400/124 |
| 4,072,224 | 2/1978 | Barnaby et al. | 400/124 |
| 4,101,017 | 7/1978 | Englund et al. | 400/124 |
| 4,129,390 | 12/1978 | Bigelow et al. | 400/121 |
| 4,236,836 | 12/1980 | Hodne | 400/124 |
| 4,288,167 | 9/1981 | Carson et al. | 400/121 |

*Primary Examiner*—Paul T. Sewell

*Attorney, Agent, or Firm*—Arthur T. Fattibene

[57] ABSTRACT

An impact type dot matrix printing head in which a plurality of dot printing elements, each of which is formed of a thin flat sheet material, are stacked in the direction of their thickness and each being capable of sliding relative to one another when actuated. The dot matrix printer arrangement is such so as to efficiently add to the number of dot printing elements making up a given matrix so as to increase the density of the multiple dots to form more legible characters, to reduce the size and weight of the dot matrix printer, and to improve its durability. A plurality of electro magnets for individually actuating a corresponding associated dot printing element are circumferentially spaced in one or more stages spaced longitudinally along the dot matrix. In one form of the invention an intermediate portion of the respective dot printing elements are offset or oppositely deviated to reduce wear and/or resistance between adjacent dot printing elements.

3 Claims, 7 Drawing Figures

DOT MATRIX PRINTING HEAD

This is a continuation application of application Ser. No. 330,340 filed Dec. 14, 1981, abandoned entitled Dot Matrix Printer.

BACKGROUND OF THE INVENTION

1. Field of the Invention

This invention pertains to an improvement in or relating to an impact type printer for printing characters of the like by actuating and controlling a plurality of dot printing elements.

2. Description of the Prior Art

In dot matrix printers, characters, symbols or the like to be printed on recording paper are formed and displayed by multiple dots. In order to have these characters or symbols clear and legible, therefore, it is preferred to increase the density of multiple dots. Hence, printing portions of dot printing elements must be arranged extremely close to one another. On the other hand, since these dot printing elements are individually actuated and controlled by respective electromagnets, a space is required around each dot printing element to dispose each electromagnet to be interconnected to the dot printing element.

for the abovementioned reasons, the conventional dot matrix printer generally have a construction in which a wire is employed for each dot printing element, the end portion of the dot printig element at which the printing portion is to be disposed is arranged as close as possible to the other and each dot printing element is curved in the arcuate form and is spaced apart from the other so that the electromagnet may be disposed in that space. Accordingly, when the dot printing element is actuated by a control signal, a considerable surface pressure acts upon a guide member that restricts the dot printing element in the arcuate form and is brought into sliding contact with the dot printing element under such a state. Among others, since the guide member close to the printing portions must support altogether a group of dot printing elements within a predetermined size, accuracy of the guide member is likely to drop due to abrasion even if a material having especially high wear resistance is employed for the guide member. Moreover, because the increase in curvature of the dot printing element is restricted by possible occurrence of buckling or the like, addition of dot printing elements would result in a remarkable increase in the volume of the dot matrix printer.

SUMMARY OF THE INVENTION

It is therefore an object of the present invention to provide a dot matrix printer which is light in weight and compact in size and does not cause drop in accuracy even when used for an extended period or when dot printing elements are additionally disposed, by use of such an arrangement in which the dot printing elements need not be curved as required in the prior art.

To accomplish this object, in the dot matrix printer in accordance with the present invention, a plurality of dot printing elements, each being formed of a thin sheet, are contiguously stacked to form the dot matrix printer, and the driving force of electromagnets is introduced to the dot printing elements from the side surfaces of these thin sheets.

BRIEF DESCRIPTION OF THE DRAWINGS

The accompanying drawings illustrate preferred embodiments of the present invention, in which.

DESCRIPTION OF THE PREFERRED EMBODIMENTS

Figure 1A:
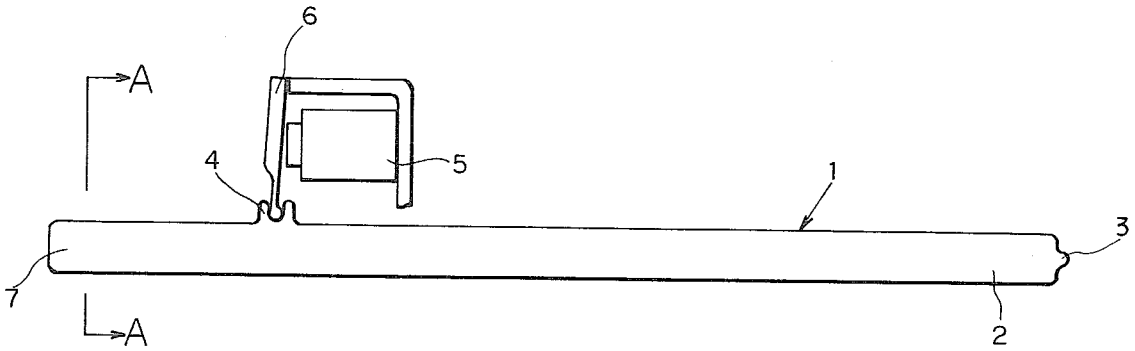
FIG. 1A is a plan view of a dot printing element engaging with an electromagnet.
Figure 2A:
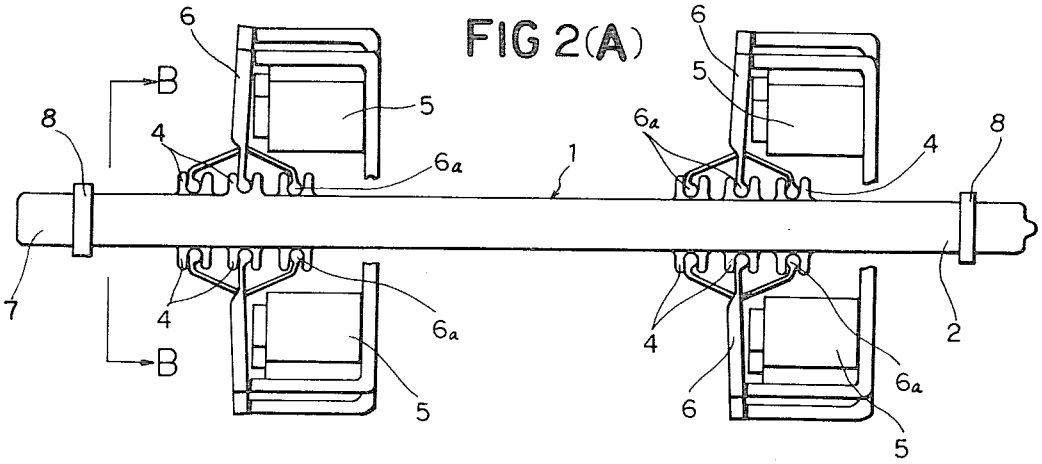
FIGS. 2A and 2B are plan and side views, respectively of a dot matrix printer formed by contiguously stacking the dot matrix dot printing elements shown in FIGS. 1A and 1B.

FIGS. 1A and 2A illustrate an embodiment of the present invention. Reference numeral 1 represents a dot printing element formed by a thin, flat sheet material. A printing portion 3 is formed at the leading end portion 2 of this dot printing element 1 so as to protrude there from in the direction of the major axis of the dot printing element 1 (in the direction passing through the center of the sheet width). An engaging portion 4 is formed on one side of the dot printing element 1.

An armature 6 of an electromagnet 5 engages with the engaging portion 4 so that when a control current is applied to the electromagnet 5, the armature 6 is caused to displace to the right and left as viewed in the drawing and the dot printing element 1 is also caused to displace to the right and left, thereby dotting printing paper.

Figure 2B:
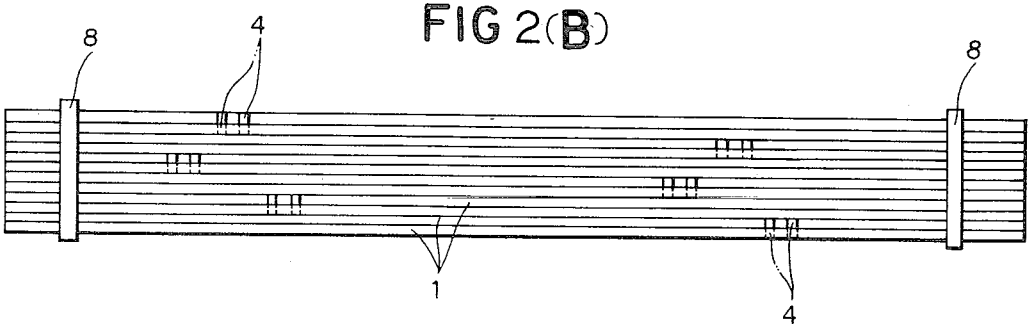
Figure 3:
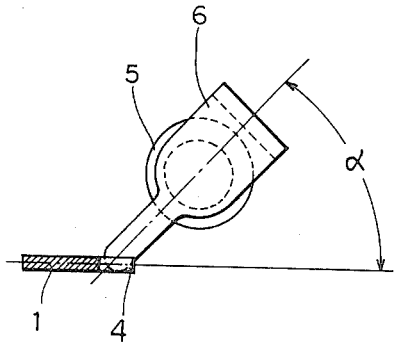
FIG. 3 is a sectional view taken along line A—A of FIG. 1A.
Figure 4:
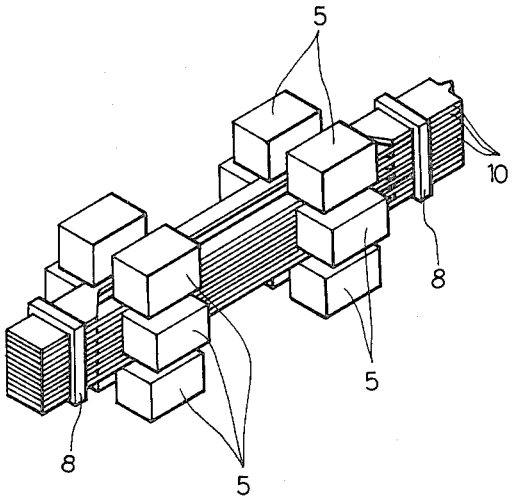
FIG. 4 is a perspective view of a dot matrix printer formed by stacking the dot printing elements shown in FIG. 1B.
Figure 5:
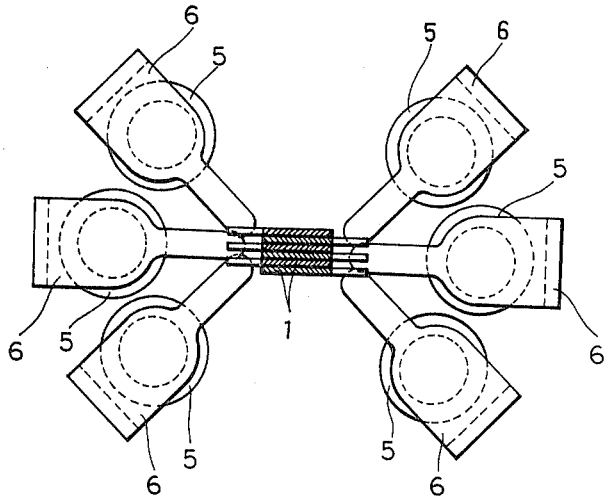
FIG. 5 is a sectional view taken along line B—B of FIG. 2A.

A required number of printing elements 1, 1 . . . are then contiguously stacked in the direction of thickness of the sheets as shown in FIG. 2B and are restricted at their leading and trailing end portions 2, 7, respectively, by guide members 8, 8 . . . , thereby forming a dot matrix printer. In this case, a group of electromagnets 5, 5 . . . are circularly arranged so as to encompass or circumscribe the dot printing elements 1, 1 . . . , as shown in FIG. 4 or 5. This arrangement becomes possible because the engaging portion 4 can be disposed at an arbitrary position or longitudinally staggered along each dot printing element 1 in the axial direction and because the angle $\alpha$ of engagement between the engaging portion 4 and the armature 6 can be selected almost arbitrarily. If the positions of these engaging portions 4, 4 . . . are suitably selected, a multi-stage arrangement of the electromagnets 5, 5 . . . can be made extremely easily. If the number of the dot printing elements 1 is 12, for example, twelve electromagnets 5, 5 may be divided and arranged in two stages as shown in FIG. 4. If the number of the dot printing elements is 18 and 24, for example, they may likewise be halved to accomplish the two stage arrangement, respectively. This arrangement makes it possible to assemble the dot matrix printer in an extremely compact form.

If the end portion 6*a* of each armature is suitably bent as shown in FIG. 2A, it becomes possible to arrange circularly the electromagnets 5, 5 . . . inside one place and to disperse the positions of engagement of the engaging portions 4, 4 . . . with respect to the armatures 6, 6 . . . in the direction of the major axis of the dot printing elements 1, 1 . . . . This arrangement makes it possible to avoid inconveniences that would otherwise occur because the positions of engagement are extremely close to one another. Since the electromagnets 5, 5 are disposed inside one plane, the construction of yokes to be fitted to these electromagnets 5, 5 . . . can also be simplified.

Figure 1B:
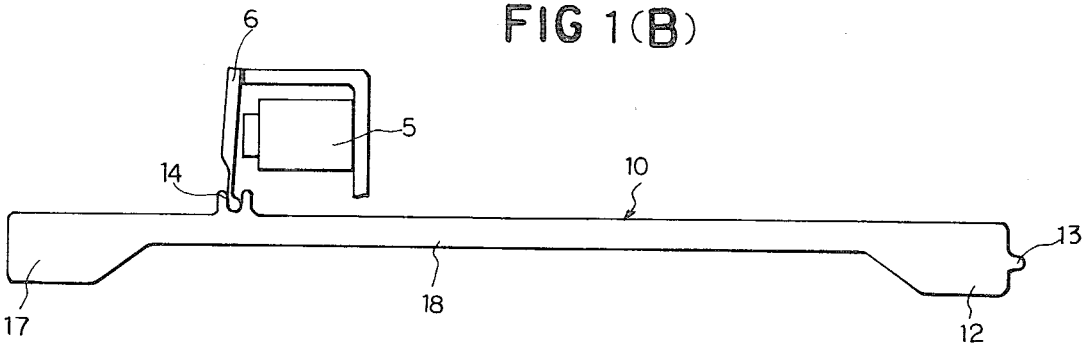
FIG. 1B is a plan view of a dot printing element whose intermediate portion is deviated.

Since the dot matrix printer using the thin sheet-like dot printing elements is capable of guiding the stack of the dot-printing elements as a whole by means of one guide member as described above, the construction of the printer can drastically be simplified, but is not free from the problem that the operation of the dot printing elements is hindered by the frictional force because adjacent dot printing elements come into direct contact with each other. To eliminate this problem, the intermediate portion 18 of each dot printing element 1 other than its leading and trailing end portions 12, 17 is vertically deviated from the axis (X—X) passing through the centers of the end portions 12, 17, such as shown in FIG. 1B, in which the intermediate portion 18 is shown deviated upwardly.

Next, the required number of dot printing elements 10, each having the above-described shape, are laminated to form the dot matrix printer as shown in FIG. 4. In this case, the dot printing elements 10 are alternately turned inside out so that the intermediate portions 8, 8 of a pair of adjacent dot printing elements are deviated from each other to the right and left in the direction of the major axis XX. The distance of deviation between the intermediate portions 8, 8 of the adjacent dot printing elements is determined such that the dot printing elements 10, 10 laminated as described above do not come into contact with the adjacent dot printing elements 10, 10 during the printer operation. According to the construction of the dot matrix printer described above, the intermediate portions 18, 18 . . . of the dot printing elements 10, 10 . . . do not come into contact with one another and the friction between the sheets occur only at the end portions 12, 17 at which the dot printing elements 10, 10 . . . are restricted by the guide member 8, 8.

In accordance with the dot matrix printer having the above-described construction, when a control current is fed to a particular electromagnet to excite the same, a particular dot printing element engaging with that particular electromagnet undergoes displacement and performs the dotting operation. A group of dots thus generated by the control current prints a desired letter or the like (including a symbol, a diagram, a figure and the like). Since the dot printing elements are not curved unlike the conventional elements, the surface pressure of the guide member does not rise remarkably. Consequently, the frictional resistance is reduced between the dot printing elements and the guide member, reducing the power required for driving the dot printing elements, and the size of the electromagnets can be also reduced. This is extremely advantageous for additionally disposing the dot printing elements. Especially, it is no longer necessary in the present invention to employ a material having high wear resistance and high hardness for the guide member in the proximity of the printing portion, unlike the prior art. Hence, machining of the guide member becomes extremely easier and since abrasion hardly occurs, printing quality is not deteriorated over an extended period of time.

The driving force by the electromagnets is transmitted to the dot printing elements via the engaging portions on their side edge surfaces so as to utilize maximum flexural rigidity. According to this arrangement, even if the dot printing elements receive the driving force, they operate stably without undergoing buckling. In connecting the dot printing elements and the electromagnets for their engagement, the relation of their relative positions is so free that even when additional printing elements are disposed, the space of additional disposition of the electromagnets does not become insufficient. Unlike the prior art in which the printing portion is circular, the printing portions in the printer of the present invention are square so that the dot printing elements can be disposed by far closer to one another than in the prior art printer. Hence, extremely clear printing can be obtained.

In a dot matrix printer in which the intermediate portions of the dot printing elements are deviated from the major axis so as not to come into contact with one another, abrasion is reduced between the dot printing elements as described already, so that the operation of the dot printing elements becomes by far light and speedy, thereby reducing the required power. In consequence, the size of the electromagnets can be reduced, thus making it possible to reduce the size and weight of the dot matrix printer itself. Even if the dot printing elements 1, 1 . . . undergo elastic flexural deformation during operation, the intermediate portions 7, 7 . . . neither come into contact with one another nor interfere with their dotting operation to inhibit smooth printer operation.

Because of all of these advantages described above, in the dot matrix printer in accordance with the present invention, restriction hardly exists on the additional disposition of dot printing elements, and far clearer printing can be obtained as compared with the prior art.

What is claimed is:

1. An improved impact type dot matrix printing head comprising a plurality of straight flat printing elements, said printing elements being arranged in a contiguously disposed stacked relationship, whereby the respective major axis thereof are substantially disposed in a common intersecting plane, each of said printing elements being formed of flat sheet material and having opposed end portions, and an intermediated portion therebetween, a print means disposed on one of said opposed end portions so as to project therefrom in the direction of the major axis of said printing element, said opposed end portions of said elements being wider than the intermediate portion disposed therebetween said intermediate portion being disposed to one side of the major axis of said printing element, and an engaging portion connected intermediate the length of said intermediate portion, and said engaging portion being connected to its longitudinal edge of said intermediate portion remote from said major axis, said printing elements being contiguously disposed in stacked relationship so that the intermediate portion of adjacent pairs of said elements are disposed to opposite sides of the major axis, the engaging portion of adjacent elements being oppositely disposed to one another, and the engaging portion of adjacent pairs of said printing elements being longitudinally spaced along the intermediate portion of said printing elements, a plurality of electromagnets circumferencially disposed about said printing elements, and each of said electromagnets having a armature connected to the engaging portion of a corresponding printing element.

2. A dot matrix printing head as defined in claim 1 free of any spacers interposed between adjacent printing elements.

3. A dot print matrix printing head as defined in claim 1 wherein said plurality of printing elements comprise at least twelve in number.

* * * * *